US005896791A

United States Patent [19]

Oberdorf

[11] Patent Number: 5,896,791

[45] Date of Patent: Apr. 27, 1999

[54] COMPACT CROSS SHAPED TOOL

[76] Inventor: Richard S. Oberdorf, 22415 Fresard, St. Claire Shores, Mich. 48080

[21] Appl. No.: 08/941,002

[22] Filed: Sep. 30, 1997

[51] Int. Cl.[6] ..... B25B 13/06

[52] U.S. Cl. ..... 81/124.4; 81/124.5; 81/125.1

[58] Field of Search ..... 81/124.3–124.7, 81/125.1, 462, 177.2, 177.6

[56] References Cited

U.S. PATENT DOCUMENTS 4,939,960 7/1990 Kinzli ..... 81/125.1 X

FOREIGN PATENT DOCUMENTS 2242200 3/1975 France ..... 81/124.6

2131372 1/1973 Germany ..... 81/124.5

*Primary Examiner*—D. S. Meislin

*Attorney, Agent, or Firm*—Henderson & Sturm

[57] ABSTRACT

A compact cross shaped tool 10 having a cross shaped holder unit 11 that is dimensioned to selectively receive a first cross arm unit 12 and a second cross arm unit 13. Both of the cross arm units 12, 13 are slidably received in one portion 21 of the holder unit 11 and only one of the cross arm units 13 is slidably received in the other portion 20 of the holder unit 11.

3 Claims, 1 Drawing Sheet

COMPACT CROSS SHAPED TOOL

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to the field of multiple bit hand tools in general, and in particular to a compact cross shaped multiple bit tool.

2. Description of Related Art

As can be seen by reference to the following U.S. Pat. Nos. 2,807,179; 4,327,790;, 4,848,197; and 4,926,721, the prior art is replete with myriad and diverse multiple bit hand tools.

While all of the aforementioned prior art constructions are more than adequate for the basic purpose and function for which they have been specifically designed, they are uniformly deficient with respect to their failure to provide a simple, efficient, and compact hand tool arrangement wherein a pair of tool arms are releasably locked in a cross shaped configuration such that a uniform torque force may be applied to a selected tool bit.

As anyone who has employed the prior art multiple bit tool arms is all too painfully aware, their multiple piece construction increases the chances of a component failure and/or makes it virtually impossible to apply a uniform torque force to a selected tool bit.

As a consequence of the foregoing situation, there has existed a longstanding need for a new and improved multiple bit hand tool that comprises the least possible number of interacting tool components in a simple and efficient manner and the provision of such an construction is a stated objective of the present invention.

BRIEF SUMMARY OF THE INVENTION

Briefly stated, the compact cross shaped tool that forms the basis of the present invention comprises in general, a pair of cross arm units that are releasably received in a cross shaped holder unit wherein the ends of the cross arm units are dimensioned to receive a plurality of bit units.

As will be explained in greater detail further on in the specification, the cross shaped holder unit comprises upper and lower short tubular members that are disposed perpendicular to one another such that a portion of one of the tubular members projects into the interior of the other tubular member.

As a consequence of the foregoing situation, at least one of the cross arm units will be provided with a flat recessed portion that will be slidably received within the obstructed interior of one of the tubular members to limit the travel of the cross arm unit relative to the obstructed tubular member. The other cross arm unit may be variably positioned relative to the other tubular member to vary the torque force that may be applied by the tool.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
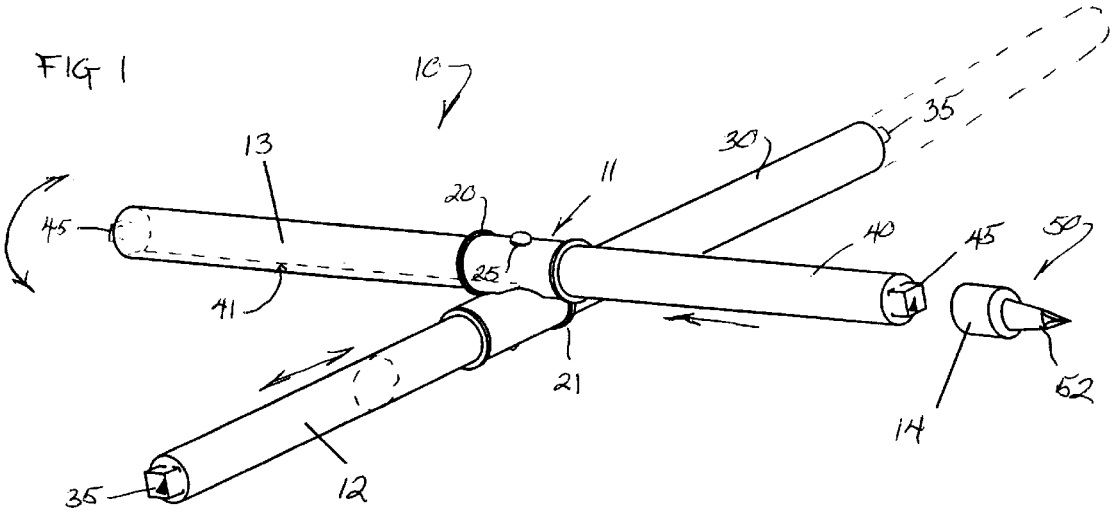
FIG. 1 is a perspective view of the assembled cross shaped tool that forms the basis of the present invention.

As can be seen by reference to the drawings, and in particularly to FIG. 1, the compact cross shaped tool that forms the basis of the present invention is designated generally by the reference number 10. The cross shaped tool comprises in general, a cross shaped holder unit 11, a first cross arm unit 12, a second cross arm unit 13 and a plurality of bit units 14. These units will now be described in seriatim fashion.

Figure 2:
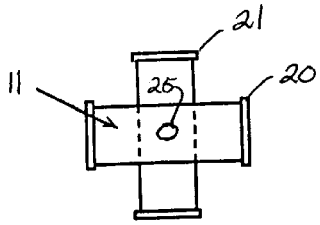
FIG. 2 is a top plan view of the disassembled cross shaped tool components.
Figure 2:
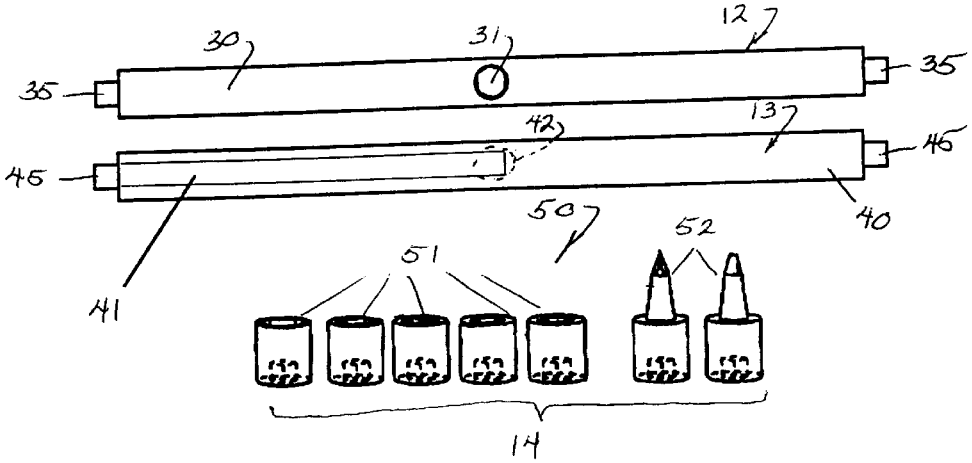
Figure 3:
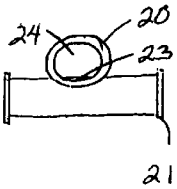
FIG. 3 is a side elevation view of the cross shaped holder unit.

As can best be seen by reference to FIGS. 1 through 3, the cross shaped holder unit 11 comprises a pair of short tubular members 20, 21 which are aligned and connected perpendicular to one another in an overlapping intersecting relationship to one another such that a portion 23 of the lower tubular member 22 will intrude into the interior 24 of the upper tubular member 20 as shown in FIG. 3.

In addition, both of the tubular members 20, 21 are provided with a central aperture 25 whose purpose and function will be described in greater detail further on in the specification.

As shown in FIGS. 1 and 2, the first cross arm unit 12 comprises a generally elongated cylindrical cross arm member 30 having a generally uniform external periphery, and a centrally disposed ball detent element 31 dimensioned to be received in the central aperture 25 in the lower tubular member 21.

Figure 4:
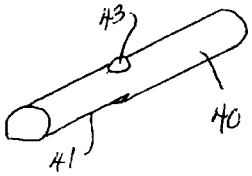
FIG. 4 is an isolated detail view of one of the cross arm units.

Furthermore, as shown in FIGS. 2 and 4, the second cross arm unit 13 comprises a generally elongated cylindrical cross arm member 40 having an elongated generally flat recess 41 extending from at least one end of the cross arm member 40 and terminating proximate the midpoint of cross arm member 40 opposite the location of a ball detent element 43 which is dimensioned to be received in the central aperture 25 in the upper tubular member 20.

As can also be seen by reference to FIGS. 1 and 2, each of the ends of each of the cross arm members 30 and 40 are provided with a hexagonal connectors 35, 45 which are dimensioned to be received by the plurality of bit units 14.

As shown in FIG. 2, the plurality of bit units 14 comprise a plurality of conventional bit attachments such as sockets 51 and screw driver heads 52 such that selected bit attachments 50 may be operatively deployed on the hexagonal connectors 35, 45 on the cross arm members 30 and 40.

When the cross shaped tool 10 of this invention is deployed in its operative mode, as shown in FIG. 1, the tool 10 occupies a substantial amount of space; however, when the tool 10 is disassembled as shown in FIG. 2, the various components occupy very little total space and can be conveniently carried in a small pouch or carrying case (not shown).

As can best be appreciated by reference to FIG. 1, the first cross arm member 30 may be inserted in either direction relative to the lower tubular member 21. Whereas, the recessed end 41 of the second cross arm member 40 can be inserted on either end of the upper tubular member 20 and then rotated such that the flat recess 41 will pass over the portion 23 of the lower tubular member 20 which obstructs the upper tubular member 20 wherein continued insertion of the second cross arm member 40 will automatically register the ball detent 42 into the central aperture 25 in the upper tubular member 20.

As can also be appreciated by reference to FIG. 1, once the second cross arm member 40 is registered in the upper tubular member 20, the position of the first cross arm member 30 relative to the lower tubular member 21 may be varied to increase or decrease the torque applying force applied by the first cross arm member 30 to the tool 10 (as shown in phantom).

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooded parts together, whereas, a screw employs a helical surface, in the environment of fastening wooden parts, a nail and a screw may be equivalent structures.

I claim:

1. A compact cross shaped tool for applying a variable torque force wherein the tool comprises:

a cross shaped holder unit including an upper hollow tubular member and a lower hollow tubular member connected to one another in a generally perpendicular fashion;

a first cross arm unit including a first elongated cross arm member having opposite ends slidably received within at least one of said tubular members;

a second cross arm unit including a second elongated cross arm member having opposite ends slidably received within at least one of said tubular members; and a plurality of bit units selectively associated with the opposite ends of said first and second cross arm members wherein said first and second cross arm members are each provided with a centrally disposed ball detent element;

the upper and lower tubular members are each provided with a discrete aperture dimensioned to receive one of said ball detent elements; and, one of said tubular members partially obstructs an interior of the other tubular member.

2.The tool as in claim 1 wherein one of said cross arm members is provided with a flat recessed portion dimensioned to be received by the obstructed interior of said other tubular member.

3. The tool as in claim 1 wherein the cross arm members are dimensioned to be individually slidably received within one of the tubular members.

* * * * *